United States Patent [19]

Schwarz

[11] 4,108,454

[45] Aug. 22, 1978

[54] ARRANGEMENT FOR SECURING A BODY TO A SKI

[76] Inventor: Günter Schwarz, Steinacherstr. 67, 8804 Au-Wadenswil, Switzerland

[21] Appl. No.: 708,695

[22] Filed: Jul. 26, 1976

[30] Foreign Application Priority Data

Aug. 6, 1975 [CH] Switzerland ..... 10352/75

[51] Int. Cl.[2] ..... A63C 5/06

[52] U.S. Cl. ..... 280/11.37 E

[58] Field of Search ..... 280/11.37 E, 601, 636, 280/607

[56] References Cited

U.S. PATENT DOCUMENTS

| | | | |
|---|---|---|---|
| 2,611,624 | 9/1952 | Gurvich | 280/601 |
| 3,910,593 | 10/1975 | Schwarz | 280/11.37 E |
| 3,951,421 | 4/1976 | Brangenberg | 280/601 |

FOREIGN PATENT DOCUMENTS

| | | | |
|---|---|---|---|
| 2,129,391 | 12/1971 | Fed. Rep. of Germany | 280/636 |
| 2,441,590 | 3/1975 | Fed. Rep. of Germany | 280/11.37 E |

*Primary Examiner*—David M. Mitchell

*Attorney, Agent, or Firm*—Werner W. Kleeman

[57] ABSTRACT

An arrangement for securing an upstanding body to a ski wherein an elastic intermediate layer is interposed between a substantially plate-shaped base portion of the upstanding body and a substantially equal size attachment plate. For the detachable connection of the attachment plate and the upstanding body there is provided at least one projection which extends upwardly from the attachment plate. At least one surface of the elastic intermediate layer possesses a sliding surface, so that the upstanding body can be shoved or rotated into a locking position relative to the attachment plate where a part of the base portion of the upstanding body locks beneath a locking portion provided at the head of the projection.

11 Claims, 9 Drawing Figures

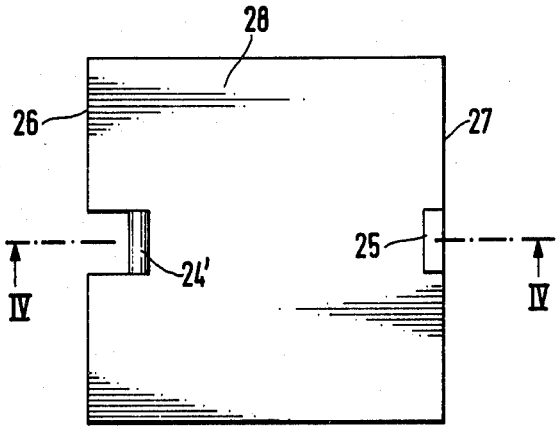
FIG. 6
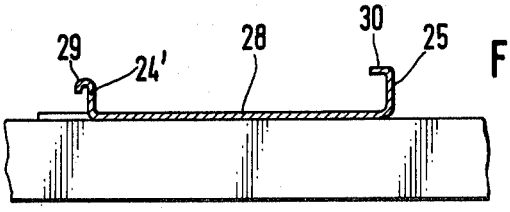
FIG. 7
FIG. 8
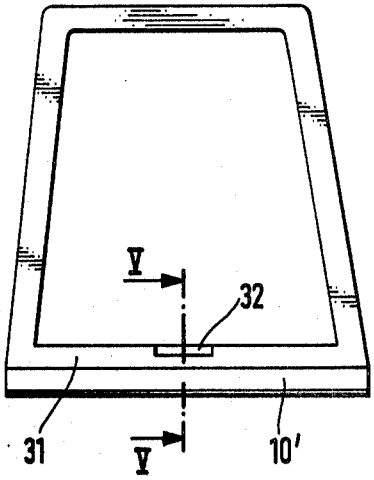
FIG. 9
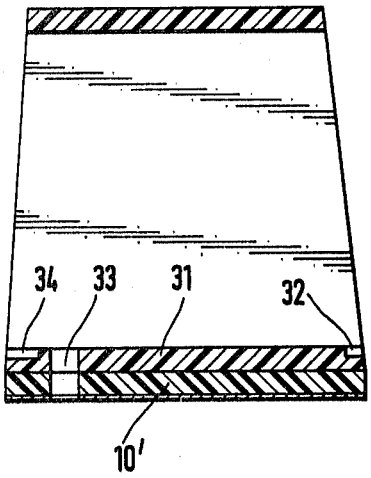

ARRANGEMENT FOR SECURING A BODY TO A SKI

BACKGROUND OF THE INVENTION

The present invention relates to a new and improved construction of an attachment arrangement for securing an upstanding body or member to a ski, wherein an elastic intermediate layer is provided between a substantially plate-shaped base portion of the upstanding body and a substantially equal size attachment plate, and at least one projection extends upwardly of the attachment plate to establish a releasable connection between the attachment plate and the upstanding body.

Such general type of attachment arrangement is known to the art, for instance from German patent publication No. 2,328,084. This prior art arrangement however requires a special locking element which must be attached after placement of the upstanding body at the outer end of at least one projection.

SUMMARY OF THE INVENTION

It is a primary object of the present invention to provide a new and improved construction of attachment arrangement for securing an upstanding body to a ski which is not associated with the aforementioned shortcomings and limitations of the prior art proposals.

Another and more specific object of the present invention aims at the provision of an attachment arrangement of the previously mentioned type wherein there can be simplified the connection of the upstanding body with the attachment plate and also its release, while obviating the need for the aforementioned locking element.

Now in order to implement these and still further objects of the invention, which will become more readily apparent as the description proceeds, the attachment arrangement of this development is manifested by the features that at least one of the surfaces of the elastic intermediate layer possesses a sliding surface, so that the upstanding body can be shifted or rotated into a locking position with respect to the attachment plate, in which position a part of the base portion of the upstanding body lockingly engages below a locking portion provided at the head or top of the projection.

Hence, with this construction there is not needed any special locking element which, after release of the connection, could easily become lost. The sliding surface can be constructed such that at the, for instance, porous, rubber-like, elastic intermediate layer there can be bonded a foil formed of a material having good sliding properties.

According to an advantageous constructional embodiment of the invention a respective projection is provided at the central portion of oppositely situated edges of the attachment plate. Due to the arrangement of the projections at the aforementioned central portion of the edges of the attachment plate there can be realized the principle described in the aforementioned German patent publication No. 2,328,084, resulting in a favorable distribution of the forces at the attachment plate and its adhesive bond with the surface of the ski.

The locking of part of the upstanding body beneath a locking portion at the head of a projection or each projection can be attained by the substantially hook-shaped construction of the head of each projection in that a part of the upstanding body can be brought below the hook-shaped head of the projection by compressing the elastic intermediate layer and displacing or rotating, as the case may be, the upstanding body.

Shifting of the upstanding body is possible due to the provision of appropriately formed slots or recesses in the plate-shaped base portion of the upstanding body.

Further, there can be provided at the plate-shaped base portion a recess into which engages, after the shifting or displacement, the hook-shaped portion or part. However, instead of a recess there can also be used to advantage a raised portion, for instance of wedge-shape, having a shoulder, over which there can slide the hook-shaped portion until it locks behind the shoulder.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 6 is a plan view of a second exemplary embodiment of attachment plate;

FIG. 7 is a longitudinal sectional view through the attachment plate of FIG. 6, taken substantially along the line VI—VI thereof;

FIG. 8 is a front view of the upstanding body which is to be secured to the attachment plate of FIGS. 6 and 7; and FIG. 9 is a longitudinal sectional view through the upstanding body, taken substantially along the line V—V of FIG. 8.

DETAILED DESCRIPTION OF THE PREFERRED EMBODIMENTS

Figure 1:
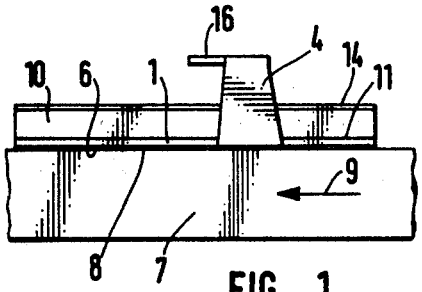
FIG. 1 is a side view of an attachment plate according to the invention having an adhesively bonded elastic intermediate layer.
Figure 2:
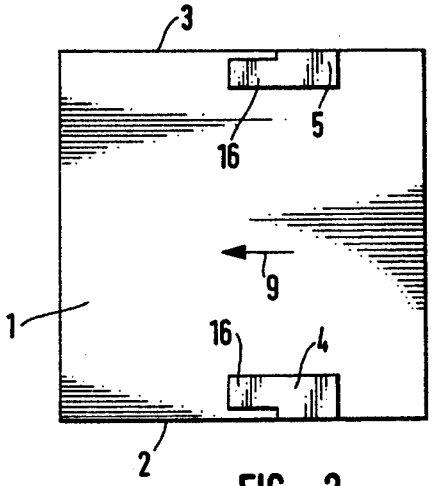
FIG. 2 is a plan view of the attachment plate of FIG. 1.
Figure 3:
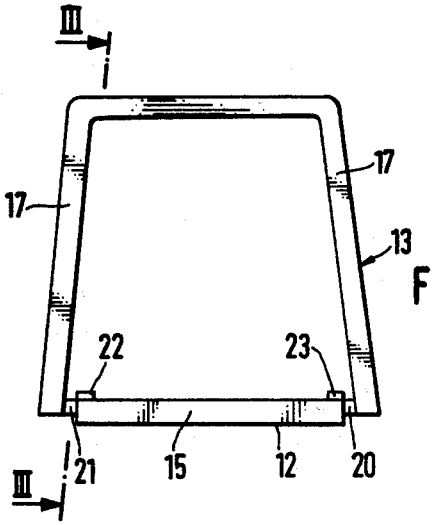
FIG. 3 is a front view of an upstanding body.

Describing now the drawings, the attachment plate 1, shown in FIGS. 1 and 2, is formed for instance of sheet metal and is provided at its opposite lengthwise edges 2 and 3 with a respective substantially hook-shaped projection 4 and 5 flexed upwardly and formed of sheet metal. The underside 6 of the attachment plate 1 is bonded to the top surface of a ski 7 for instance with the aid of a double-sided adhesive tape or band 8. The ski 7 is assumed to travel in the direction of the arrow 9, so that the predominant impact forces to be expected in the lengthwise direction of the ski, due to the arrangement of the projections 4 and 5 at the central portion of the lengthwise edges 2 and 3, can be optimumly absorbed by the elastic intermediate layer 10.

This elastic intermediate layer 10 of the attachment arrangement is, for instance, adhesively bonded to the top surface 11 of the attachment plate 1, but however also could be secured to the underside 12 of the upstanding body or member 13 to be secured to the ski. What is important is that the surface of the intermediate layer 10 which initially remains free or exposed possesses a sliding surface 14, for instance formed by a foil, a thin sheet material or the like, rendering possible easy sliding introduction of the substantially plate-shaped base portion 15 of the upstanding body along the sliding surface 14 below the hook-shaped portions 16 of the projections 4 and 5.

Figure 4:
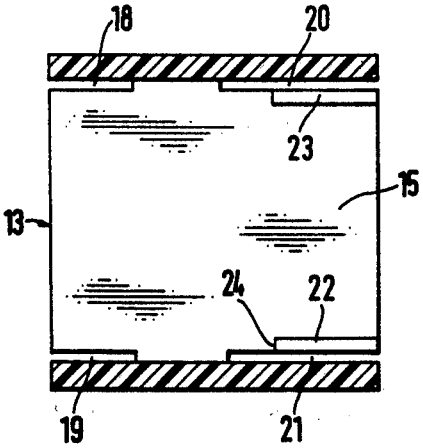
FIG. 4 is a horizontal sectional view of the upstanding body.

The upstanding body 13 serves to prevent crossing of the skis during skiing and to render skiing in deep snow easier. Its generally trapezoidal shape with an open cross-section is known for instance from Swiss Pat. No. 526,970 and U.S. Pat. No. 3,761,106, to which reference may be readily had and the disclosure of which is incorporated herein by reference. In order to impart a certain elasticity to this body, so that impact forces are not transmitted directly to the base portion 15, there are provided at the transition region between the base portion 15 and the side walls 17 of the upstanding body 13 cut-outs or recesses 18 to 21, as the same have been best shown by referring to FIG. 4.

With regard to the present invention these cut-outs advantageously serve for the introduction of the projections 4 and 5 of the attachment plate 1 when the upstanding body 13, for the purpose of establishing the connection, is pushed onto the attachment plate 1.

In order to be able to lock the upstanding body 13 at the attachment plate 1 there is located at the surface of the plate-shaped base portion, adjacent the slots 20 and 21, interengaging means comprising substantially wedge-shaped raised portions or protuberances 22 and 23 which terminate at a respective shoulder 24, behind which there can lockingly engage the hook-shaped portion 16 of each of the projections 4 and 5 after there has been completed the insertion of the upstanding body 13. In order to again release this thus locked connection it is only necessary to depress the upstanding body 13 and to shift the same, so that the wedge-shaped raised portions 22 and 23, during pushing-out of the upstanding body 13, can slide beneath the hook-shaped portions 16 of the aforementioned projections 4 and 5.

Figure 5:
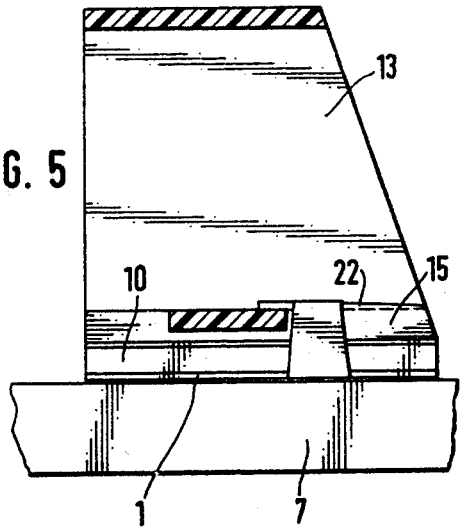
FIG. 5 is a longitudinal sectional view of the upstanding body, taken substantially along the line III—III of FIG. 3.

In the illustration shown in FIG. 5 the insertion of the upstanding body 13 is accomplished from the left towards the right.

A further exemplary embodiment of the invention has been shown in FIGS. 6 to 9. In this case a respective projection 24' and 25 is located at the transverse edges 26 and 27 respectively, of the attachment plate 28, these transverse edges being located one behind the other in the lengthwise direction of the ski. Projections 24' and 25 equally possess a substantially hook-shaped head portion 29 and 30 respectively, of which the one portion, such as the head portion 30 is horizontally flexed or bent, whereas the curvature of the other head portion of the projection 24' is continued and thus downwardly directed, as shown. In order to receive these hook-shaped head portions 29 and 30 of the projections 24' and 25 there are provided at the base portion 31 of the upstanding body a recess 32 and an opening 33, as best seen by referring to FIG. 9. Merging with the opening 33 is a further recess 34 into which engages the head portion 29 of the projection 24'. In order to be able to lockingly interengage the hook-shaped portions 29, 30 of the projections 24', 25 in the recesses 32, 34 the upstanding body, during insertion, is depressed.

It should be apparent that due to the sliding layer at the elastic intermediate layer numerous modifications of the invention are readily possible. For instance, it is conceivable to use only one projection which extends through an opening at the center of the plate-shaped base portion of the upstanding body and after rotating the upstanding body the head portion of such projection arrives at a locking position. The elasticity of the intermediate layer, for each of the embodiments, insures for positive locking of the upstanding body at the attachment plate.

While there are shown and described present preferred embodiments of the invention, it is to be distinctly understood that the invention is not limited thereto, but may be otherwise variously embodied and practiced within the scope of the following claims.

What is claimed is:

1. An attachment arrangement for an upstanding body which is adapted to be secured to a ski, comprising an upstanding body having a substantially plate-shaped base portion, an attachment plate, an elastic, resiliently compressible intermediate layer between the plate-shaped base portion of the upstanding body and the attachment plate, at least one projection means extending upwardly from the attachment plate for establishing a releasable connection between the attachment plate and the upstanding body, said elastic intermediate layer having at least one surface comprising sliding surface means extending essentially parallel to said attachment plate for enabling the upstanding body to be selectively and slidably moved in a direction relative and substantially parallel to the attachment plate from an unlocked position into a locked position wherein the upstanding body is locked at the attachment plate, said projection means and base portion of the upstanding body including interengaging means for releasably locking said upstanding body in locked position.

2. The attachment arrangement as defined in claim 1, wherein the elastic intermediate layer includes a foil defining the sliding surface means.

3. The attachment arrangement as defined in claim 1, wherein the attachment plate has oppositely situated edges, said projection means being provided at each of said edges.

4. The attachment arrangement as defined in claim 3, further including slot means provided at the base portion of the upstanding body for receiving the projection means.

5. The attachment arrangement as defined in claim 3, wherein the projection means are located at edges of the attachment plate which are adapted to extend in the lengthwise direction of the ski.

6. The attachment arrangement as defined in claim 1, wherein the attachment plate has edges which are adapted to extend transverse to the lengthwise direction of the ski, each of said edges being provided with projection means.

7. The attachment arrangement as defined in claim 1, wherein the interengaging means comprises a substantially hook-shaped locking element on said projection means.

8. The attachment arrangement as defined in claim 7, wherein said interengaging means on said base portion includes recess means provided at the surface of the base portion of the upstanding member for lockingly receiving the hook-shaped locking element of the projection means.

9. The attachment arrangement as defined in claim 8, wherein the base portion of the upstanding body is provided with an opening for receiving the projection means.

10. An attachment arrangement for securing an upstanding body to a ski, comprising an upstanding body having a substantially plate-shaped base portion, an attachment plate, adapted to be secured to the ski, an elastic, resiliently compressible intermediate layer interposed between said base portion and attachment plate, said attachment plate having oppositely disposed edges which are adapted to extend in the lengthwise direction of the ski, said edges each having a central region, projection means extending upwardly from each edge of the attachment plate at the central region thereof for releasably connecting said upstanding body with said attachment plate, said elastic intermediate layer having at least one surface comprising sliding surface means extending essentially parallel to said attachment plate for enabling the upstanding body to be slidably movable in a direction relative and substantially parallel to the attachment plate from an unlocked position to a locked position wherein, is said locked position, the upstanding body is locked to the attachment plate, the projection means at each edge of the attachment plate including a substantially hook-shaped locking element, slot means provided at the base portion of the upstanding body for receiving a respective locking element, said base portion further including wedge-shaped raised portions over which said hook-shaped locking elements slide when said upstanding body is moved from said unlocked position toward said locked position, said wedge-shaped raised portions each terminating at shoulder means for lockingly engaging a respective hook-shaped locking element of the projection means.

11. An attachment arrangement for securing an upstanding body to a ski, comprising an upstanding body having a substantially plate-shaped base portion, an attachment plate adapted to be secured to the ski, an elastic, resiliently compressible intermediate layer interposed between the base portion and the attachment plate, means extending upwardly from the attachment plate for releasably securing the upstanding body to the attachment plate in a locked position, sliding surface means arranged between said intermediate layer and said base portion and extending substantially parallel to the attachment plate for enabling sliding movement of the upstanding body in a direction relative and substantially parallel to the attachment plate from an unlocked position to said locked position.

* * * * *